US006910584B2

(12) United States Patent
Newth

(10) Patent No.: US 6,910,584 B2
(45) Date of Patent: Jun. 28, 2005

(54) DISPLAY BOX HAVING A HINGE INCLUDING A FLEXIBLE AND RIGID PORTION

(75) Inventor: Terry Newth, Doncaster (AU)

(73) Assignee: Henderson McPherson Pty. Ltd., West Heidelberg (AU)

( * ) Notice: Subject to any disclaimer, the term of this patent is extended or adjusted under 35 U.S.C. 154(b) by 53 days.

(21) Appl. No.: 10/365,533

(22) Filed: Feb. 13, 2003

(65) Prior Publication Data

US 2004/0159580 A1 Aug. 19, 2004

(51) Int. Cl.[7] ..... B65D 43/16; B65D 85/20

(52) U.S. Cl. ..... 206/755; 206/443; 220/837; 220/845; 229/125.11; 229/125.19

(58) Field of Search ..... 206/751, 754–755, 206/443, 446; 229/125.07, 125.08, 125.11, 125.18, 125.19, 165; 220/836–838, 841, 845

(56) References Cited

U.S. PATENT DOCUMENTS 1,277,536 A * 9/1918 Binder ..... 229/125.11
1,792,679 A * 2/1931 Davis et al. ..... 206/575
1,859,049 A * 5/1932 Poppe ..... 206/754
2,326,281 A * 8/1943 Becker ..... 229/125.08

* cited by examiner

*Primary Examiner*—Bryon P. Gehman
(74) *Attorney, Agent, or Firm*—Oliff & Berridge, PLC

(57) ABSTRACT

A display box including a base tray and lid, the lid being connected to the base tray by a hinge element formed integrally with the lid. The hinge element includes a formed flexible hinge portion having inner and outer webs extending between the lid and base tray across an offset between their rear walls. It also includes a rigid hinge portion that lies adjacent to the inner face of the base tray's rear wall, and is attached to a tray insert via a tab. The arrangement is such that, at closure, the lid sits flush on the base tray, and such that the lid can remain in an open position inclined to the vertical, with the flexible hinge portion taut and the lower end of the lid rear wall abutting the outer face of the base tray rear wall. This allows an item to be displayed in the box in an attractive and pleasing manner.

21 Claims, 9 Drawing Sheets

DISPLAY BOX HAVING A HINGE INCLUDING A FLEXIBLE AND RIGID PORTION

The present invention relates to display boxes. It relates for example to box and carton packaging that allows a boxed article to be displayed in a box with the box lid open.

BACKGROUND OF THE INVENTION

It is well known to use boxes or cartons made from card blanks and the like as packaging. The boxes may be used for example to package food and drink items, and many other types of goods.

The boxes generally provide protection for the items, and/or may provide an aesthetically pleasing form of packaging. The appearance of the packaging may be especially significant when the box is used for luxury goods and gifts, such as bottles of wines, spirits, perfumes, cosmetics, fine chocolates, ornaments and the like.

Such boxes generally comprise a base tray in which the item rests and a lid for closing the base tray.

Often, it is desired to display the boxed item, such that the item itself can be seen in the box. This may be for advertisement purposes, for example at a place of sale, such as in a shop display, or may be for a more personal purpose, such as for display on a shelf in a home or office. Thus, the item will often be displayed in the box with the box lid open.

In some cases, such a display might be achieved by having a completely removable lid.

A more aesthetically pleasing arrangement is to have the lid partially open, for example rotated in the region of 100°–150°. One method of achieving this is to provide a support ribbon between the lid and the base, such that as the lid is rotated, the ribbon is pulled taut to hold the lid in place at a set limited opening position.

Although aesthetically pleasing, the construction of such ribbon boxes can be complicated and can require a number of constructional steps. This is undesirable, especially where a large number of boxes are to be produced.

SUMMARY OF THE INVENTION

The present invention aims to provide an alternative packaging construction that can provide an attractive display box, as well as facilitating a simple constructional process.

Viewed from one aspect, the present invention provides a display box including:

a base tray having a rear wall, a lid having a rear wall, and a hinge element for connecting the lid with the base tray;

wherein the hinge element extends along at least a part of an inner lower edge of the lid rear wall, and includes a flexible portion that is attached to the lid and a rigid portion that is mounted within the base tray and lies adjacent the rear wall of the base tray;

the arrangement being such that when the lid is hinged open, the flexible hinge portion extends over an upper end of the base tray rear wall, and, on becoming taut, limits the degree of opening of the lid and holds the lid in place, upright, at an angle to the vertical.

The present invention is able to provide a stylish box packaging that allows a boxed item to be viewed in the box with the lid open, without the need for the support ribbon of the prior art.

As no support ribbon is required, the box construction may be kept simple, and, for example, the box tray and lid need not be held in place at an angle to one another whilst a ribbon is fixed in position. Also, the lack of a ribbon can provide a box of less cluttered appearance, with cleaner lines.

The rigid hinge portion enables the flexible portion of the hinge element to be manufactured to the needed tolerances to allow the lid to open as desired, and facilitates correct location of the hinge element in the box base.

It should be understood that the term "rigid" in "rigid hinge portion" implies that the rigid hinge portion is rigid relative to the flexible portion, and is suitably rigid so as to provide the needed locating qualities during manufacture and assembly. It may therefore have a degree of give, and may be e.g. a stiff card of the same rigidity as card from which the lid may be made, and of more rigidity than the flexible portion, which may be made of a paper sheet that is thinner than the lid card.

The rigid portion may be anchored so that, as the lid is opened, it may move slightly upwards parallel with the rear wall of the box tray, and so that, as the lid is closed, it may move back down. This provides for a degree of tolerance in the manufacturing processes, and aids in the prevention of tear of the flexible portion (which e.g. may be of paper construction). In general, only a relatively small movement is required, e.g. of the order of a few millimetres.

In a particularly preferred embodiment, the box includes an insert mounted within the base tray for holding the item that is to be boxed.

Preferably, the hinge element is attached to the insert. For example, the box may include a tray insert that is designed to fit snugly within the base tray and to hold the packaged item, e.g. a bottle or bottles of wine, in place. In this case, as the lid is opened, the hinge element may raise the insert slightly as the flexible portion of the hinge element is pulled taut over the upper end of the base tray's rear wall. The lid is then held in position under the counterweight of the tray insert and packaged goods.

The hinge element may connect to the insert via a tab portion extending from the lower edge of the rigid hinge portion. The tab may for example be affixed to the base of the insert.

In a particularly advantageous constructional method, the lid and hinge element are formed together, with the lid and rigid hinge portion being formed from the same piece of card and being held together by a liner sheet and/or decorative wrapping sheet provided on the card. The liner sheet and/or decorative wrap may then form the flexible hinge portion.

In one embodiment, the liner sheet is placed on the side of the card that is to be the inner surface of the lid, over at least a slotted portion of the card, and the combined lid blank and hinge element profile is then cut out of the card and liner combination. In this case, the flexible hinge portion is the portion of the liner sheet that extended over the slotted part of the card, and will extend from the inner facing side of the lid's rear wall to the inner facing side of the rigid hinge element.

The integral fabrication of the lid and hinge element allows the width of the flexible hinge portion to be determined within suitable tolerances by an accurate cut of the slot in the card from which the lid and rigid hinge portion are produced.

A liner sheet and/or decorative wrap may also extend past the lower edge of the rigid hinge portion to provide an attachment tab for e.g. attachment to an insert in the base tray. Attachment may be achieved for example by a suitable adhesive or tape.

As well as having the flexible hinge portion extend down from the inner side of the lid into the base tray (e.g. from an inner surface of the lid's rear wall as a continuation of a liner paper to the rigid hinge portion), the flexible hinge portion preferably also extends from the outer side of the lid into the base tray. The hinge portion may for example comprise a pair of webs extending from an inner edge of the bottom end of the lid's rear wall and from an outer edge of the bottom end of the lid's rear wall to the inside of the base tray. These webs could be part of a liner sheet for the inner web and part of a wrap (e.g. a decorative wrap) or the like for the outer web. In a preferred embodiment, each web attaches to one side of the rigid hinge portion. The extra web can provide additional strength to the hinge, and can enhance the aesthetics of the box. The extra web can provide cleaner lines and e.g. hide bare card along the lower end of the lid rear wall.

In a particularly preferred embodiment, the flexible hinge portion is formed so as to curve or kink in a direction generally perpendicular to its longitudinal length. It may for example be provided with a score or crease line or a line of weakness along its length. It is formed such that the lid rear wall and the rigid hinge portion in use naturally take up positions that are offset from one another, rather than lying in the same plane. The offset shaping may be impressed into the flexible portion and/or provided e.g. by scoring the flexible portion along its length. The flexible portion may be formed to take up the offset curving straight away, or to assume the appropriate curving when assembled with the base tray.

The provision of a weakness/curvature in the flexible portion enables the lid to sit flush on the base tray, when the box is closed, with the rear walls of the lid and base tray lying in the same vertical plane. This provides a particularly neat and pleasing appearance. The use of the rigid hinge element would normally cause the lower part of the flexible portion to be mounted somewhat inwardly of the base tray rear wall (by the thickness of the rigid portion). Without the kink or offset that the shaping of the flexible element can provide, the lid would be pulled forward of the base tray, providing a mismatch between the two. The shaping of the flexible element, however, allows the lid and base tray to remain flush in a pleasing manner.

Where the flexible hinge portion also includes an outer web part, then this too may be suitably shaped, although a positive shaping step is not necessarily required, as if the inner web (e.g. paper liner) is already shaped prior to wrapping, then the wrapping can conform to the inner web shape on wrapping or on fitting of the lid and box together.

Preferably, the lower edge of the lid's rear wall and/or the upper edge of the base tray's rear wall are vertically offset from one another when the box is closed, at least where the flexible hinge portion is provided. For example, whilst e.g. a front wall and side walls of the lid may rest on the top ends of the corresponding walls of the base tray, there is preferably a gap between the bottom end of the lid rear wall and the top end of the base tray rear wall. This may be achieved by having the lid and/or base tray rear walls of lesser height than the other lid or base tray walls. When in the closed position, the flexible hinge portion extends across the gap made by the offset. The offset accommodates the flexible hinge portion, and can provide tolerance and reduce the possibility of the flexible hinge portion tearing.

The width of the flexible hinge portion will generally determine the amount to which the lid opens, and the vertical offset between the two rear walls helps to accommodate this flexible portion. The offset may also however affect the opening angle that the lid takes on. For example, if the hinge element is unchanged but the offset is increased by reducing the height of the rear wall, then the lid may open to a higher degree.

In the open position, the end of the lid rear wall will generally abut against the outer surface of the base tray's rear wall to aid in holding the lid in position.

The box parts may be made of any suitable materials of any suitable dimensions. For example, the base tray, lid and insert may be made of folded card blanks, whose thickness, and so rigidity, may vary depending on the goods being packaged. Typical card might be e.g. box board and typical thicknesses may be e.g. In the range of 1200 $\mu$m–2400 $\mu$m (48 to 96 point).

The box parts may be lined with suitable liner sheets, e.g. liner paper, and may be wrapped with suitable wrappings, e.g. a decorative paper wrap or the like.

The box itself may take any suitable shape and size, and may be rectangular, square or any other shape.

The present invention also extends to a method of making a display box, and, viewed from another aspect, the present invention provides a method of making a display box, the method including the steps of:

forming a base tray from a blank, the base tray having a rear wall;

forming a lid from a blank, the lid having a rear wall and a hinge element; and connecting the lid to the base tray through the hinge element;

wherein the hinge element includes a flexible portion that extends from an inner lower edge of the lid rear wall, and a rigid portion that is mounted within the base tray and lies adjacent the rear wall of the base tray;

the arrangement being such that when the lid is hinged open, the flexible hinge portion extends over an upper end of the base tray rear wall, and, on becoming taut, limits the degree of opening of the lid and holds the lid in place, upright, at an angle to the vertical.

Preferably, the lid and hinge element are formed integrally with one another. In one embodiment, a slot is formed in a blank sheet, a liner sheet (e.g. a paper liner) is placed over the blank sheet, at least over the area of the slot, and the lid and hinge blank is cut from the blank sheet, the blank's perimeter cut intersecting the slot towards its ends so as to split the resulting blank into separate lid and rigid hinge portions connected by the liner sheet (the connecting portion of the liner sheet acting as the flexible hinge portion).

A wrap, e.g. a decorative sheet or other cover, may be placed over the lid and base tray blanks, and may be suitably adhered in place, Where the wrap extends over the flexible hinge portion, it can reinforce the liner sheet, and can provide an outer web to the liner sheets inner web.

Preferably, an insert, which may also be formed from a blank, is placed within the base tray, and the hinge element is preferably anchored to this.

A particular advantage of the present invention is that it allows the base tray, lid and insert to be formed separately, these parts only being brought together at the end of the manufacturing process, e.g. to adhere the hinge part of the lid to the insert, and place the insert and hinge within the base tray.

Preferably, the flexible hinge portion is formed such that in the box it takes on a kinked or doglegged shape. This may be achieved e.g. by providing a line of weakness or bend along its length, e.g. by scoring along its length or by impressing a shape or weakness point along it.

The forming allows the rear walls of the lid and base tray to lie flush in the same plane when the box is closed. In one embodiment, the forming is achieved by running a suitably profiled instrument along the length of the flexible portion to score it. In another particularly preferred embodiment, a blank for an integral lid and hinge element is pressed between a platen and forming element to impress a shape into the flexible element. This may be achieved by mounting the blank on a platen with a spacer below the rigid hinge portion so as to raise that portion up from the platen above the level of the lid portion of the blank. The height raised will generally correspond with the thickness of the rigid hinge portion. The forming element includes a projection, such that when the forming element and platen are brought into contact with one another, the projection engages the flexible hinge portion to suitably shape it.

Preferably, the box and/or lid blanks are shaped so that the rear walls of the two are offset from one another when the box is closed. This may be achieved e.g. by cutting the box tray and/or lid blanks so that the rear wall of one or both is narrower that the other walls.

Preferably, the hinge element is mounted to an insert in the base tray, and a wrap is preferably provided on the outside of the lid and hinge element so as to extend below the lower end of the rigid hinge element to provide a tab for the attachment with the insert.

The present invention further extends to a display box including a base tray, an insert within the base tray for holding an item for display, a lid, and a hinge element integrally formed with the lid for mounting the lid to the base tray, wherein:

the base tray includes a rear wall having an upper end;

the lid includes a rear wall having a lower inner edge from which the hinge element extends; and the hinge element includes a flexible portion that extends from the lower inner edge of the lid rear wall to a rigid portion lying within the base tray adjacent the base tray's rear wall, the rigid portion being attached to the insert;

the arrangement being such that when the lid is hinged open, the flexible hinge portion extends over the upper end of the base tray rear wall, and, on becoming taut, pulls against the insert via the rigid hinge portion to limit the degree of opening of the lid and hold the lid in place, upright, at an angle to the vertical.

The present invention further extends to a method of making a display box, the method Including the steps of:

forming a base tray from a blank;

forming a lid and hinge element from a blank, including the steps of forming a slot in a blank sheet, providing a liner sheet at least across the slot on the side of the sheet that will be to the inside of the box, and cutting a blank from the blank sheet such that the perimeter of the cut intersects the slot towards the ends of the slot so as to define a lid wall flap and a rigid hinge element that are connected together by a flexible hinge element formed from the paper liner that extended across the slot;

and mounting the rigid hinge portion inside the base tray adjacent a rear wall of the base tray;

the arrangement being such that when the lid is hinged open, the flexible hinge portion extends over an upper end of the base tray rear wall, and, on becoming taut, limits the degree of opening of the lid and holds the lid in place, upright, at an angle to the vertical.

Viewed from another aspect the present invention provides a display box including:

a base tray having a rear wall;

a lid including a rear wall; and a hinge element having a flexible hinge portion that extends from a lower inner edge of the lid rear wall to an inwardly facing surface of a rigid hinge portion, the rigid hinge portion lying within the base tray adjacent the base tray's rear wall and the flexible hinge portion being shaped along its length such that it forms a dog leg/offset across its width, the arrangement being such that when the display box is closed the lid and base tray lie flush with respect to one another, and such that when the lid is hinged open, the flexible hinge portion extends over an upper end of the base tray rear wall, and, on becoming taut, limits the degree of opening of the lid and holds the lid in place, upright, at an angle to the vertical.

The offset provided by the flexible hinge portion offsets the plane in which the lid rear wall lies from the plane in which the rigid hinge portion lies, to provide the flush fit of the base tray and lid.

The present invention extends to a method of making a display box, the method including the steps of:

forming a base tray from a blank, the base tray having a rear wall;

forming an integral lid and hinge element, the lid having a rear wall and the hinge element having a flexible portion that extends from an inner lower edge of the lid rear wall and a rigid portion that extends from the flexible portion;

shaping the flexible portion, e.g. by scoring or by impression, so that it will take up a dog leg/offset across its width; and connecting the lid to the base tray through the hinge element such that the rigid portion is mounted within the base tray and lies adjacent the rear wall of the base tray;

the arrangement being such that when the display box is closed the lid and base tray lie flush with respect to one another, and such that when the lid is hinged open, the flexible hinge portion extends over an upper end of the base tray rear wall, and, on becoming taut, limits the degree of opening of the lid and holds the lid in place, upright, at an angle to the vertical.

Various modifications on the above are possible, and various other advantages of the present invention may be seen from the following description of the invention.

BRIEF DESCRIPTION OF THE DRAWINGS

Embodiments of the present invention will now be described, by way of example only, with reference to the accompanying drawings. It is to be understood that the particularity of the drawings does not supersede the generality of the preceding description of the invention.

In the drawings.

DETAILED DESCRIPTION OF THE INVENTION

Figure 1:
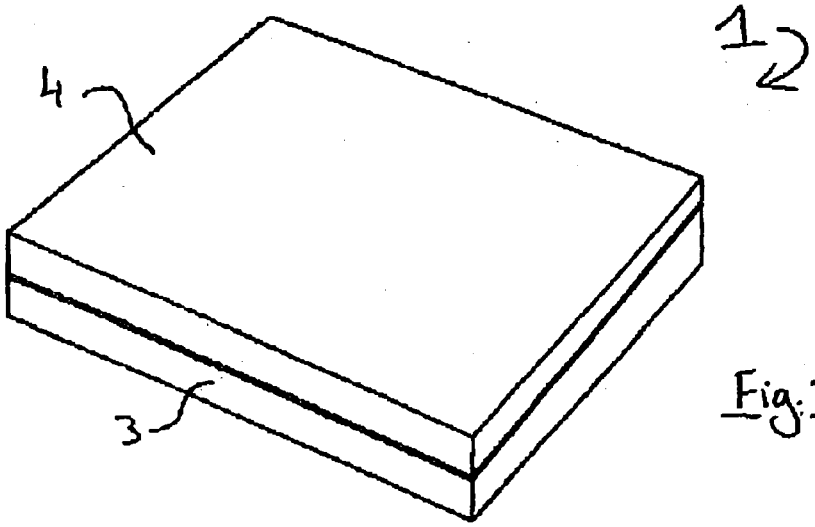
FIG. 1 is a perspective view of a closed display box in accordance with one embodiment of the present invention that holds six bottles.
Figure 2:
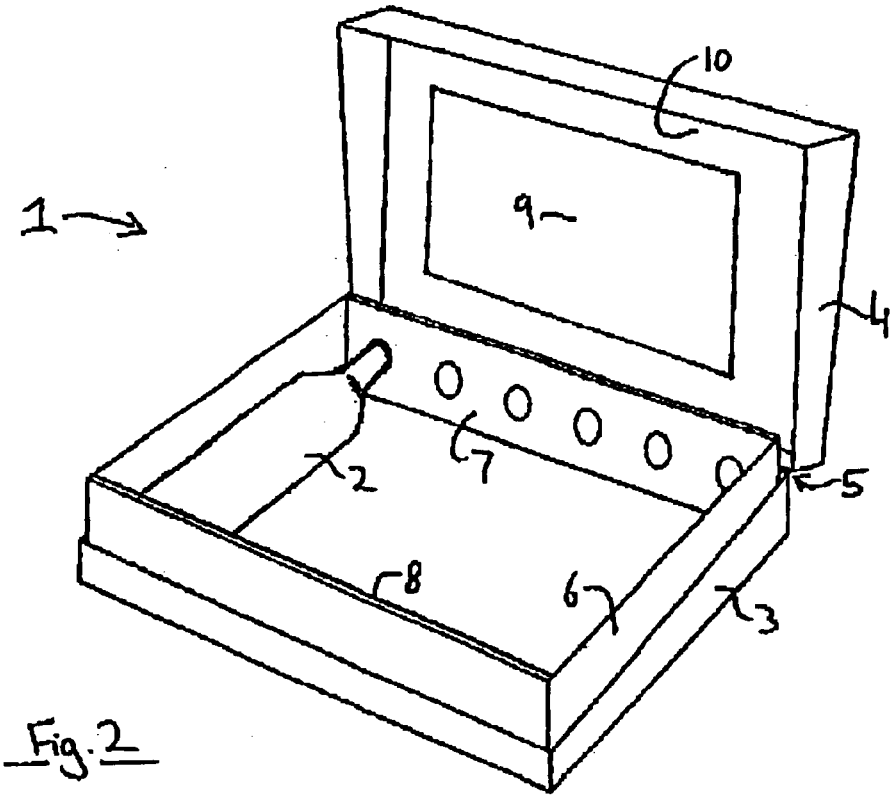
FIG. 2 is a similar view to FIG. 1, but with the box open and showing a single bottle in place.

Referring to FIGS. 1 and 2, a display box or carton 1 for e.g. a plurality of wine bottles 2 includes a base tray 3 and a lid 4 connected together by a hinge element 5.

The box 1 also Includes a tray insert 6 for holding the bottles 2. The tray insert 6 includes a holder 7 for the neck of the bottles and a holder 8 for the base of the bottles.

The various parts are formed from card blanks that are suitably cut, folded, wrapped and glued into shape.

The box 1 provides an inexpensive yet attractive packaging for the bottles 2.

The box 1 is configured such that the lid 4 can be hinged into an open position in which it remains upright, inclined to the vertical, so as to display the bottles 2 in the box 1, whilst providing a pleasing overall appearance.

The lid 4 may include writing or other graphics 9 on its inner surface 10, which may provide information on the displayed product, for example information about the bottled wine or about the associated winery, winemaker or the like. The display box 1 may therefore be configured so that the lid 4 lies open at an angle suitable for ease of reading of the graphics 9.

Typically, when the box 1 is open, the angle between the rear wall of the base tray 3 and the top face of the lid 4 may be between 100°–150°, although other angles are also possible.

The graphics 9 could be on a plastics label or badge or the like. Alternatively or also, a clear sheet may be provided, so that the goods may be seen with the lid both opened and closed.

An important feature of the box 1 is that the hinge element 5 allows the lid 4 to remain in an upstanding, inclined, position without the need for a ribbon between the base tray 3 and the lid 4 to prevent the lid 4 from falling fully open.

Figures 3A, 3B, 3C:
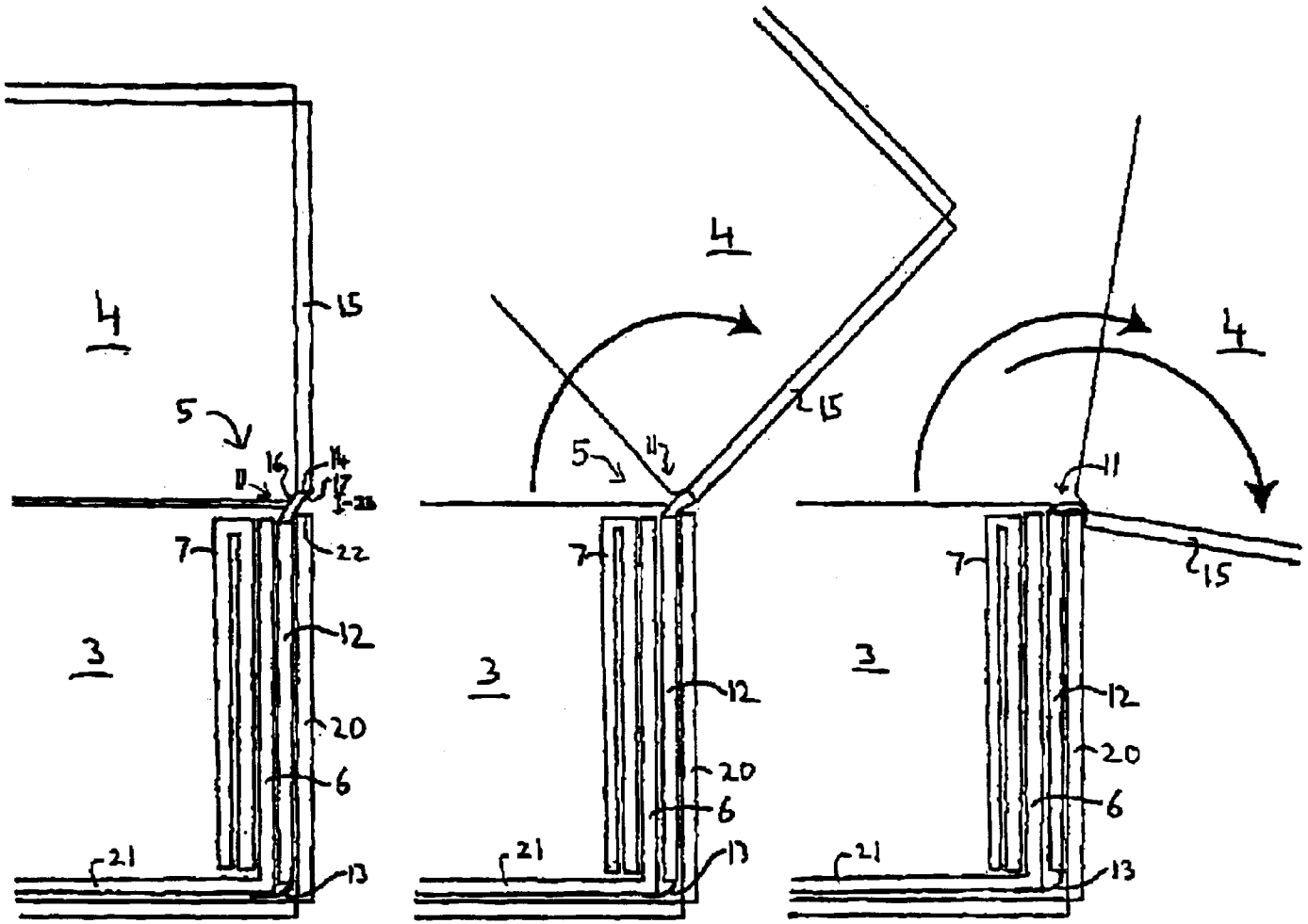
FIGS. 3*a*–3*c* are cross-sectional views of a rear portion of the box of FIG. 1 at various stages of opening.
Figure 4:
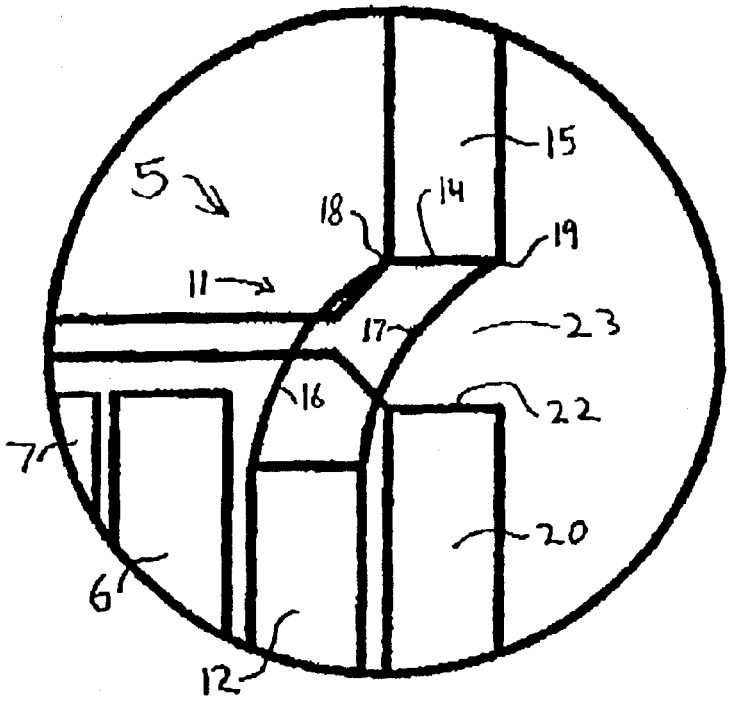
FIG. 4 is an enlarged cross-sectional view of the hinge portion of the box of FIG. 1.
Figure 5:
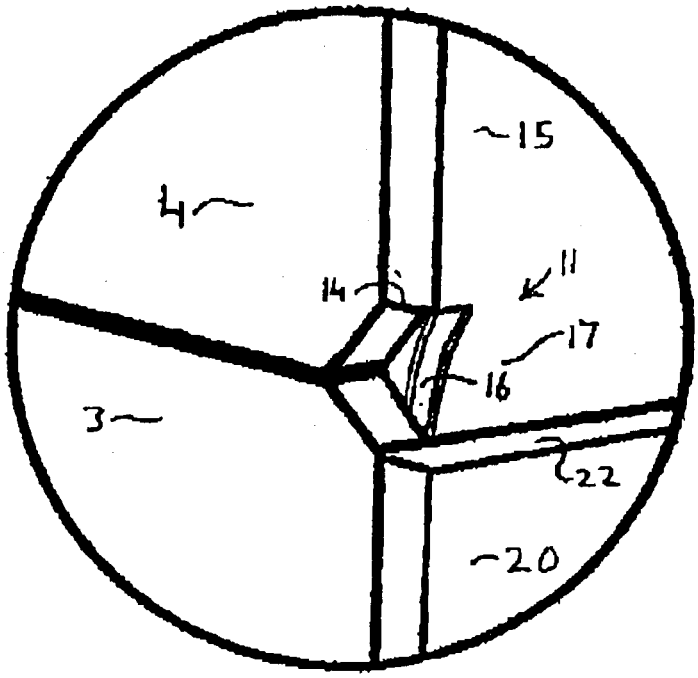
FIG. 5 is an enlarged rear perspective view of a corner of the box of FIG. 1.

The configuration and working of the hinge element 5 is shown in the cross-sections of FIGS. 3*a*–3*c*, which show the lid 4 respectively in its closed position, during opening, and in a final, open, display position. The hinge element 5 is also shown in FIGS. 4 and 5, which show the hinge element 5 in enlargement in cross-section and from a rear perspective view.

The hinge element 5 includes a flexible hinge portion 11, a rigid hinge portion 12 (that is rigid relative to the flexible portion 11) and a tab portion 13 (the latter shown in FIGS. 3*a*–3*c* only).

The flexible hinge portion 11 extends from the lower end 14 of the lid's rear wall 15 and comprises inner and outer web portions 16,17 that are connected to the lid 4 along the lower inner and outer edges 18,19 of the lid's rear wall end 14 respectively. The rigid hinge portion 12 is mounted within the base tray 3 adjacent the base tray's rear wall 20. The rigid hinge portion 12 is rectangular in shape and extends along the length of the box 1. The tab portion 13 is glued to the base 21 of the tray insert 6.

The lower end 14 of the lid rear wall 15 and the upper end 22 of the base tray rear wall 20, are vertically offset from one another and produce a gap 23 across which the flexible hinge portion 11 extends when the box 1 is closed.

The flexible hinge portion 11 is formed so that it takes up a kinked or dog legged form when the box 1 is closed, such that the natural lie of the lid rear wall 15 and rigid hinge portion 12 are offset from one another by approximately the thickness of the rigid portion 12. This allows the rear wall 15 of the lid 4 to lie flush with the rear wall 20 of the base tray 3, when the box 1 is closed, so as to provide a pleasing and neat appearance.

If there were no curvature of the flexible hinge portion 11, then the location of the rigid hinge portion 12 within the base tray 3 and the mounting of the flexible hinge portion 11 between the inner lower edge 16 of the lid rear wall 15 and the inner face of the rigid element 12, would draw the lid 4 forward of the base tray 3, and so reduce the pleasing form of the box.

In use, as the lid 4 is pivoted open, the flexible hinge portion 11 extends over the upper end 22 of the base tray rear wall 20, and becomes taut. The lid 4 thus opens to a point where the rigid hinge portion 12 and the tray insert 6 are raised slightly under the weight of the lid 4, and the lid 4 remains at rest in an opened position angled to the vertical, with the lower end 14 of the lid's rear wall 15 abutting against the outer surface of the base tray rear wall 20.

Movement of the rigid hinge portion 11 need only be slight, e.g. a few millimetres, and provides some tolerance and stress relief for the flexible portion 11.

On closure, tension is removed from the flexible hinge portion 11, and the rigid hinge portion 12 moves back down under the weight of the insert 6 and bottles 2. The lid 4 comes to rest on the base tray 3 with the rear walls 15,20 flush with one another. When closed, the outer web 18 extends across the gap 23 to provide a pleasing appearance.

As said, the various box parts are made from blanks, and a method of forming the parts is given with respect to FIGS. 6 to 14.

A particularly advantageous feature of the present invention is that the base tray 3, lid 4 (with hinge element 5) and insert 6 can be formed separately from one another in parallel manufacturing steps, and can then be brought together in a final step.

Figure 6:
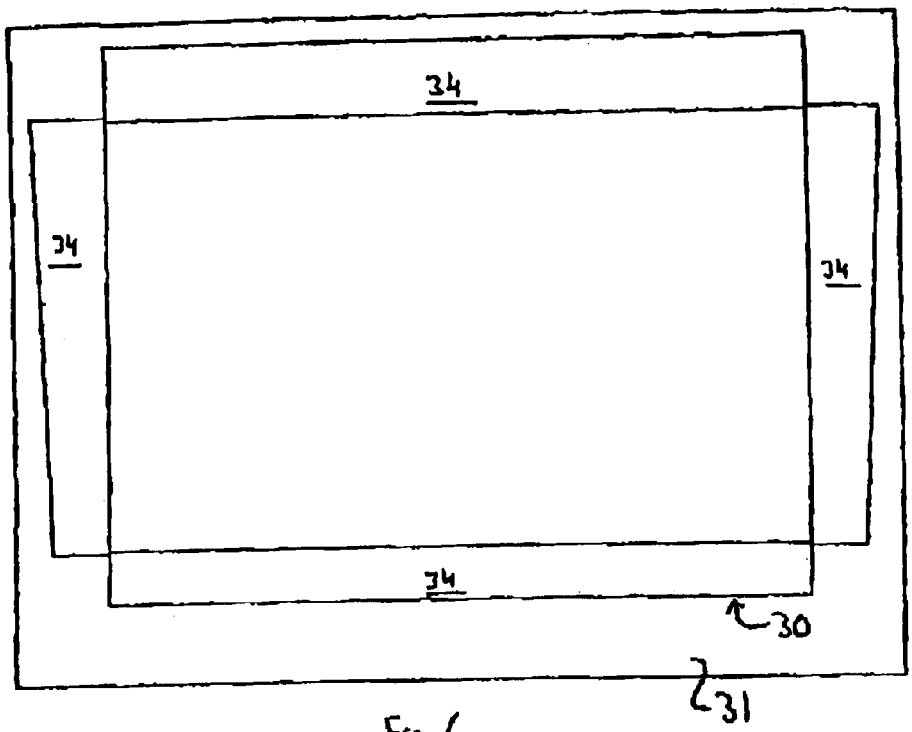
FIG. 6 shows a blank for a base tray of the box of FIG. 1.
Figure 7:
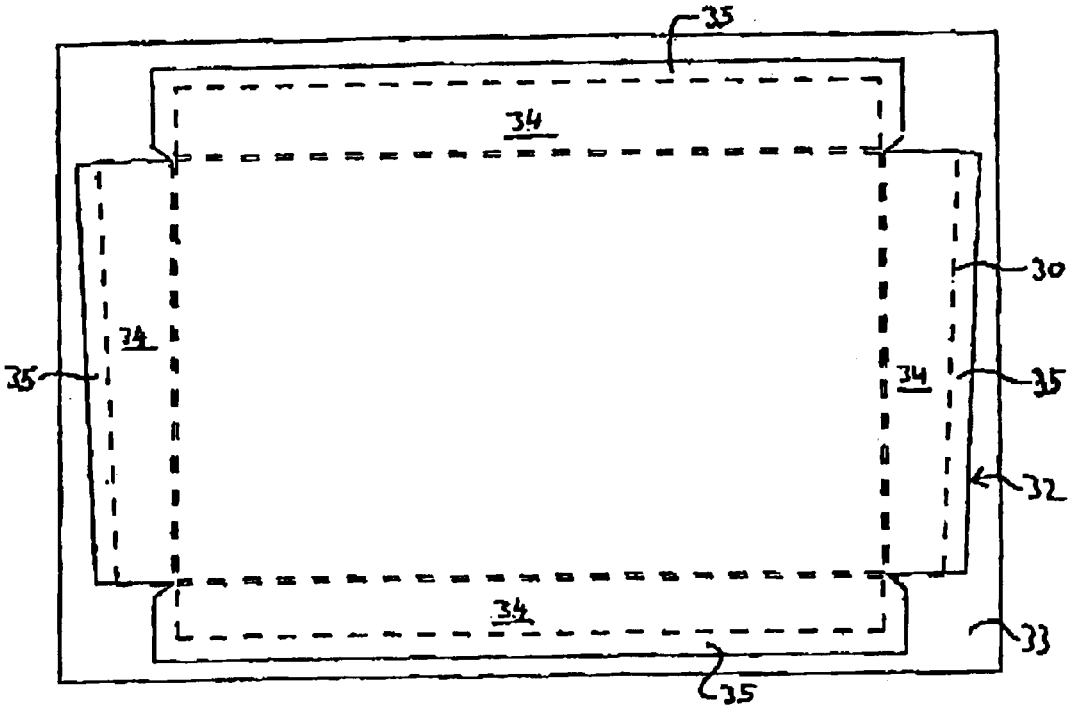
FIG. 7 shows a wrap for the base tray of FIG. 6.

Referring to FIGS. 6 and 7, a blank 30 for the base tray 3 is cut out from a sheet of card 31, and a wrap 32 for the blank 30 is cut out of a sheet of decorative paper 33 (the blank 30 is shown in phantom in FIG. 7 superimposed over the wrap 32).

During manufacture, the base tray blank 30 is formed into its erected shape, with the wall flaps 34 folded up and the corners fixed by tape, glue or other method. The wrap 32 is then placed over the outer surface of the erected base tray 3 and the overlapping portions 35 of the wrap 32 are wrapped about the edges of the erected blank 30 and glued onto its inner surface.

The upper one of the flaps 34 in the drawings forms the base tray rear wall 20, and so should be slightly narrower than the other flaps 34 so as to provide the vertical offset for the gap 23.

Figure 8:
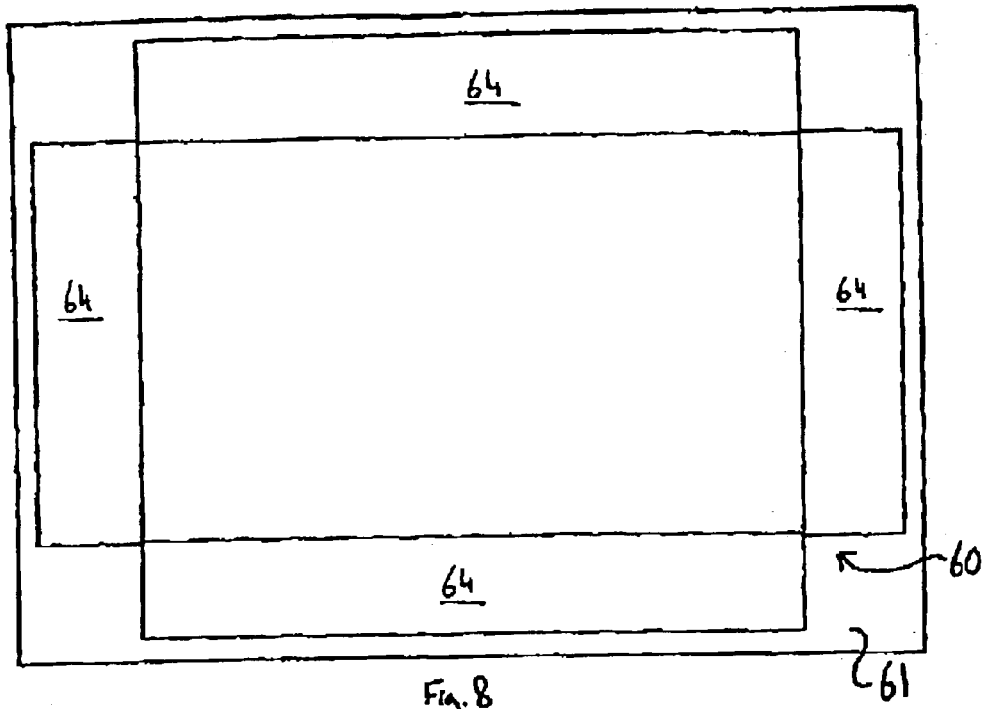
FIG. 8 shows a blank for a tray insert of the box of FIG. 1.
Figure 9:
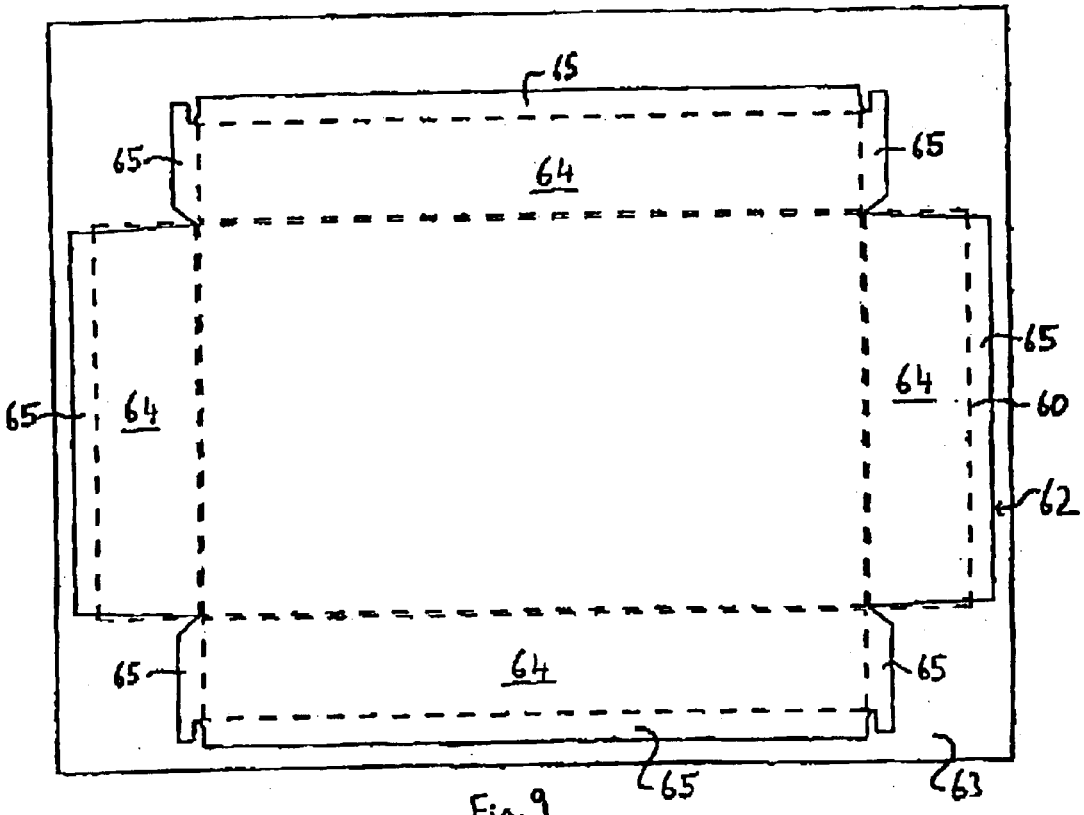
FIG. 9 shows a wrap for the tray insert of FIG. 8.

Referring to FIGS. 8 and 9, the tray insert 6 is formed in a similar manner to the base tray 3, with a blank 60 being cut from a sheet of card 61, and with a wrap 62 being cut from a decorative paper sheet 63 (the blank 60 is shown in phantom in FIG. 9 superimposed over the wrap 62).

Again, the wall flaps 64 of the blank 60 are folded up and glued or taped into an erect position, and the wrap 62 is placed over the outer surface of the resulting insert 6. The overlapping portions 65 of the wrap 62 are then wrapped about the edges of the insert 6 and glued onto its inner surface.

Figure 10:
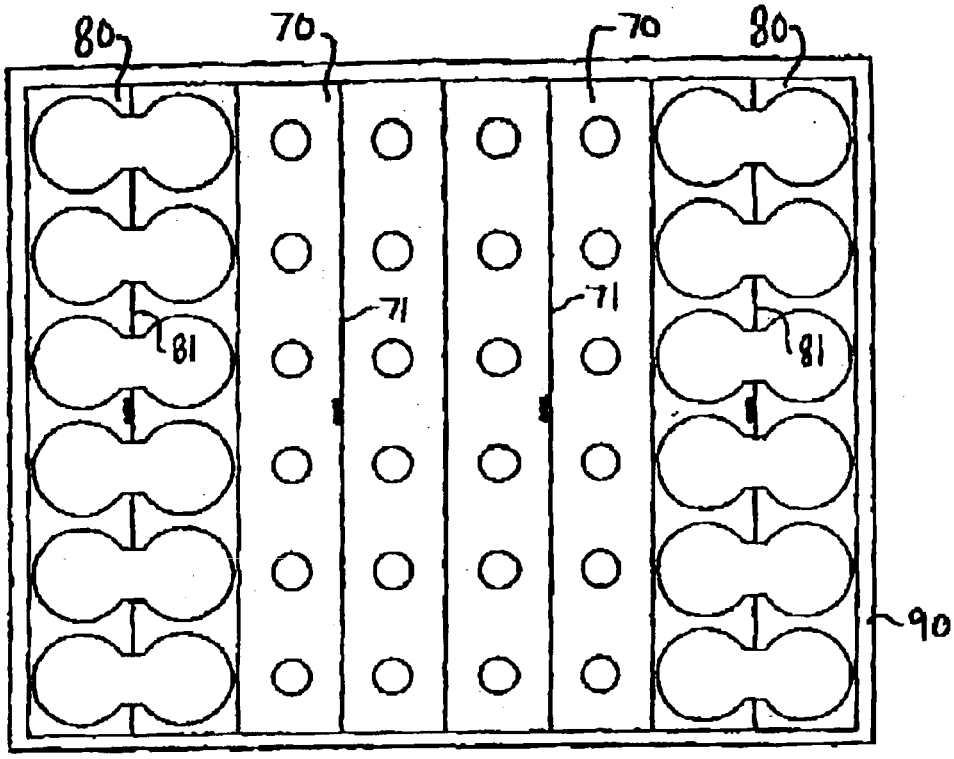
FIG. 10 shows a cut pattern for a pair of bottle holder inserts for the tray insert of FIG. 8.

Referring to FIG. 10, a blank 70 for the neck holder 7 and a blank 80 for the base holder 8 are cut from a single sheet of card 90 (In fact, for efficiency, two sets of holder blanks 70,80 are formed from the same sheet 90).

The blanks 70 and 80 are folded along their score lines 71,81 so as to provide a double card thickness, and the resulting holders 7,8 are then placed at either end of the insert tray 6, and glued into place.

The lid 4 and hinge element 5 are formed integrally with one another.

Figure 11:
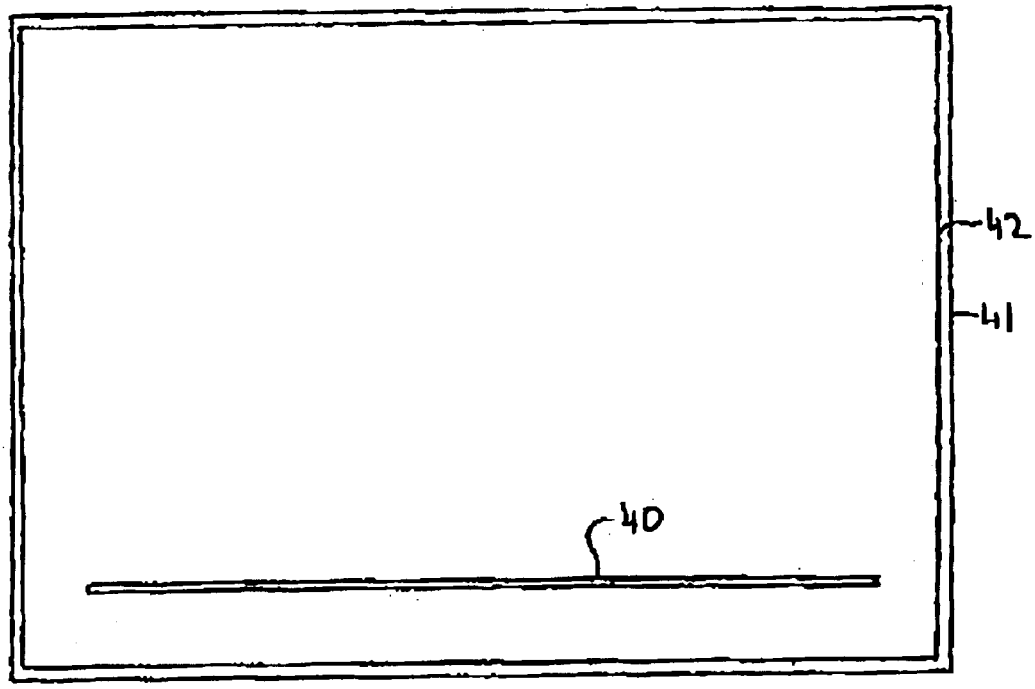
FIG. 11 shows a slotted sheet used to form a blank for a lid of the box of FIG. 1.

Firstly, as shown in FIG. 11, a slot 40 is made in a sheet of card 41, at a slot width equal to the desired width of the flexible hinge portion 11, and at a slot length greater than that of the length of the rigid element 12.

Figure 12:
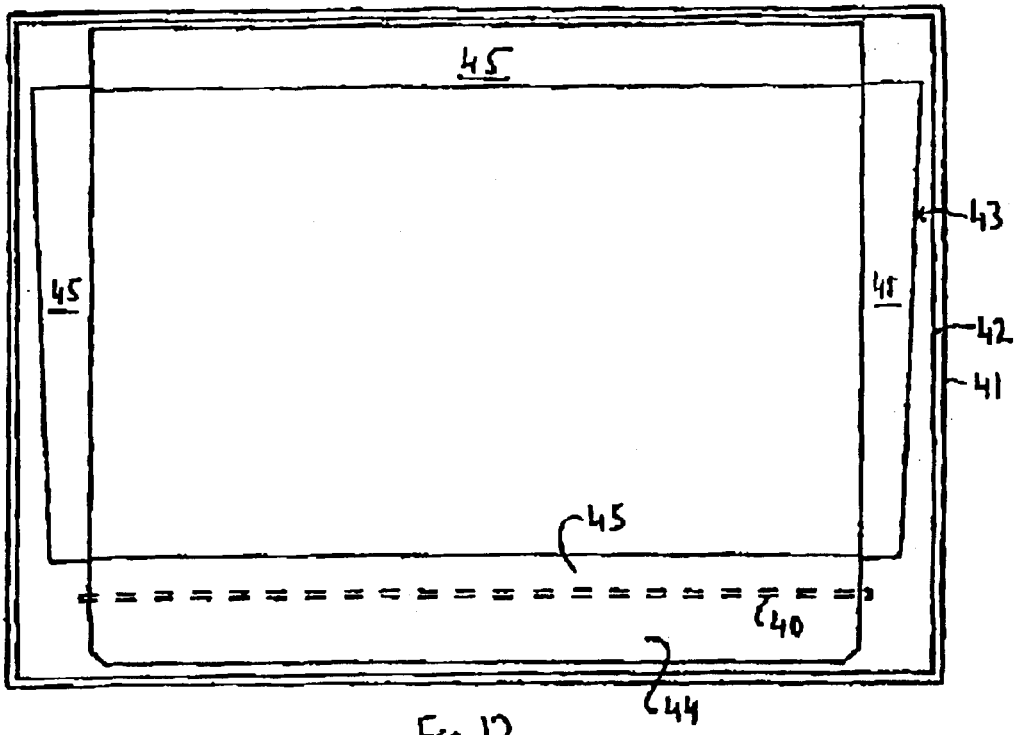
FIG. 12 shows a cut pattern for the slotted sheet of FIG. 11 for producing a lid blank.
Figure 13:
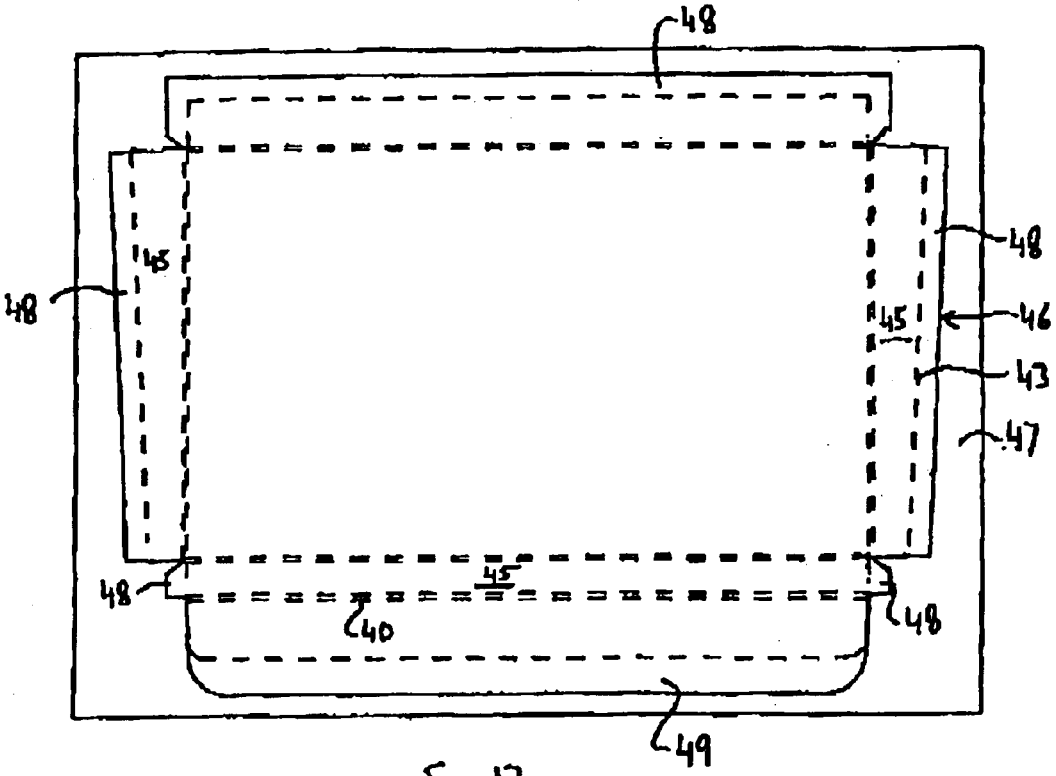
FIG. 13 shows a wrap for the lid blank of FIG. 12.
Figure 14:
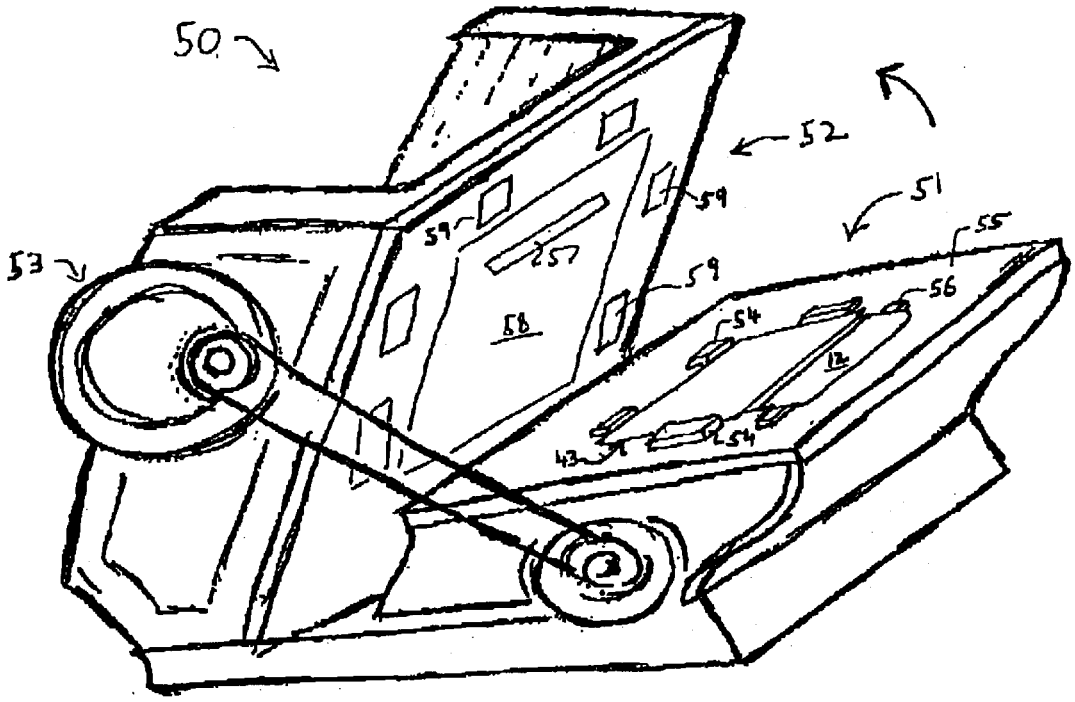
FIG. 14 is a schematic drawing of a press machine for making an impression in a hinge portion of the lid blank of FIG. 12.

A paper liner 42 is then glued onto the sheet 41 on the side that will eventually be the inner surface of the lid 4, and, as shown in FIG. 12, a blank 43 is cut out of the card and liner combination. As can be seen, the slot 40 is intersected at either end by the blank cut, and so the cutting of the blank 43 separates a blank part 44 that will form the rigid hinge portion 12 from a blank wall flap 45 that will form the lid rear wall 15, with only the paper liner 42 connecting them together. The connecting portion of the paper liner 42 defines the flexible hinge portion 11 and has the width of the slot 40.

The lid 4 is erected from the blank 43 by folding up and taping or gluing together the wall flaps 45. The lid 4 and hinge element 5 are wrapped by a wrap 46, shown in FIG. 13, that is cut from a sheet of decorative paper 47 (the lid and hinge blank 43 is shown in phantom in FIG. 13 superimposed over the wrap 46). Overlapping portions 48 of the wrap 46 are glued to the inside surfaces of the erected lid and hinge element 4,5, and the wrap 46 includes a further overlapping portion 49 that forms the tab portion 13 of the hinge element 5 (see FIGS. 3*a*–3*c*).

The portion of the wrap 46 that extends between the lid rear wall 15 and the rigid hinge portion 12 will form part of the flexible hinge portion 11 (i.e. the outer web 17) together with the portion of the paper liner 42 originally over the slot 40 (that forms the inner web 16).

Prior to erecting the lid 4 from the blank 43, the flexible hinge element 11 is shaped so as to be impressed with a kink. This may be achieved using a press machine 50 shown schematically in FIG. 14.

The press machine 50 has a platen 51 and forming element 52 that are pressed together using suitable gearing 53 to shape the lid and hinge blank 43 therebetween.

Figure 15:
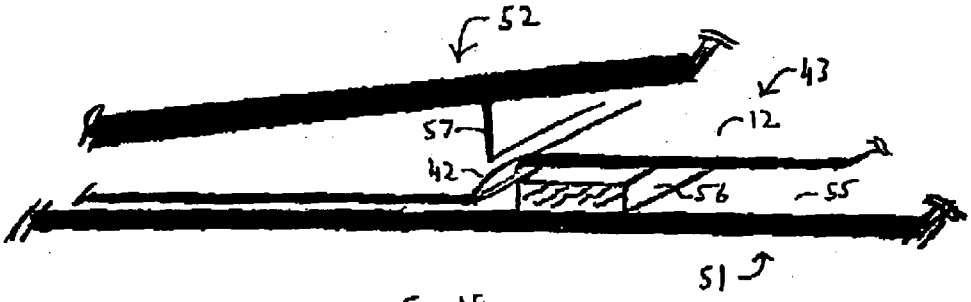
FIG. 15 is a schematic close-up of a lid and hinge element blank in the press machine of FIG. 14.

The platen 51 Includes a plurality of locating elements 54, which may be e.g. rubber strips, that hold a lid and hinge blank 43 in place on a metal surface 55, with the rigid hinge portion 12 lying atop a spacer 56, e.g. a piece of Perspex™ material, as best seen in close up in FIG. 15. The spacer 56 is about the thickness of the rigid hinge portion 12, and the paper liner 42 is towards the forming element 52.

The forming element 52 includes an elongate projection 57 that engages with the paper liner 42 when the platen 51 and forming element 52 are pressed together, so as to provide the required kink in the flexible hinge portion 11. The projection 57 is mounted on a wood forme 58 that is held in place on a metal base by clamps 59. It may comprise e.g. a 6-point crease rule that protrudes out about 5 mm.

Although the wrap 46 also forms a part of the flexible hinge portion 11, it does not require impressing or scoring, and will follow the profile defined by the inner web 16/inner liner 42.

When the base tray 3, lid 4 and insert 5 are all formed, which can be mechanised and carried out automatically using standard blank forming machines, the three parts are brought together. The tab portion 13 of the hinge element 5 is firstly glued to the base of the tray insert 6, and then the tray insert 6 is placed into the base tray 3 with the rigid hinge element 12 lying parallel with and adjacent to the base tray's rear wall 15. Through this action, the base tray 3 and lid 4 become hingedly connected to form the box 1.

The offset 23 of the rear walls 14, 15 is provided through a suitable difference in height of the rear walls from the other walls, as defined by the shapes of the base tray and lid blanks.

The card material, sizes and thicknesses will depend on the box's purpose, typical card would be standard types of box board, and typical thicknesses would be in the range of about 1200 $\mu$m–2400 $\mu$m (48 to 96 point), although other materials and thicknesses would be possible.

The extent to which the lid is angled can be altered by varying the width of the flexible element 11 and the vertical offset 23 of the rear walls 15,20.

Figure 16:
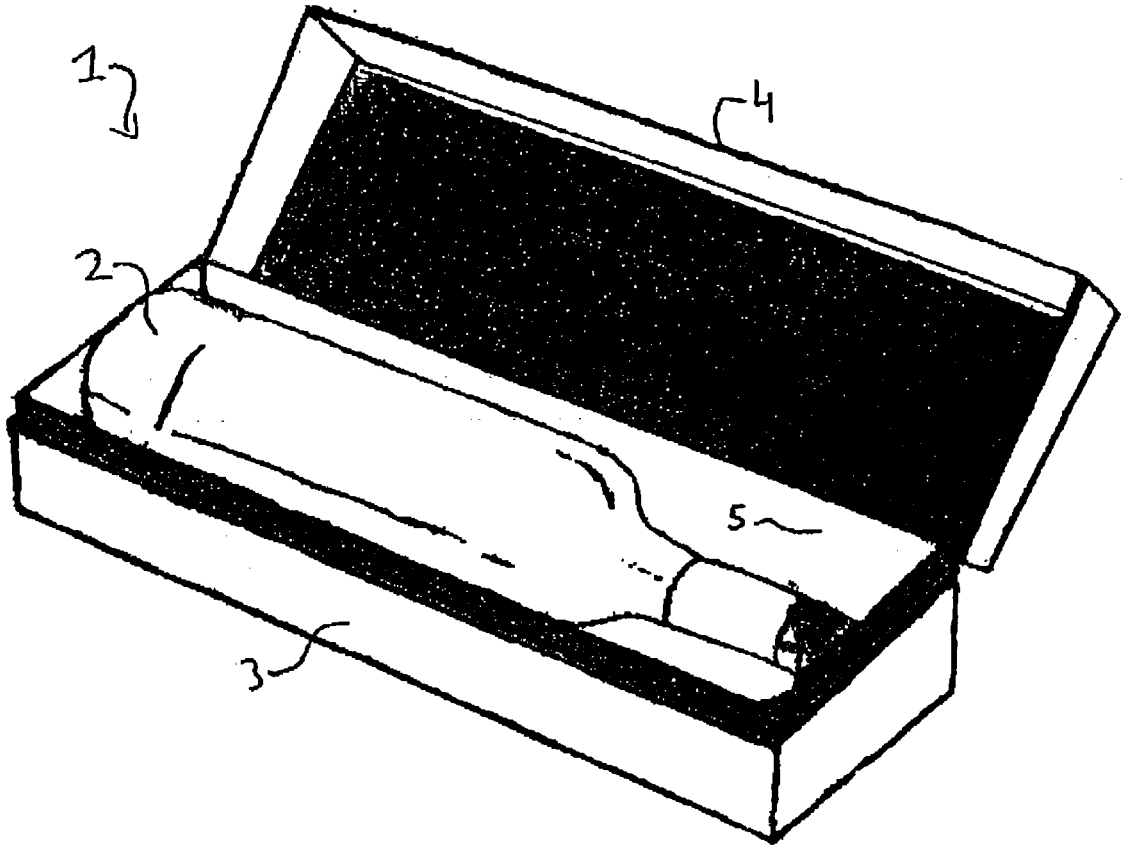
FIG. 16 shows a display box for a single bottle.

The box shape may take on a number of different shapes and sizes, and a one-bottle box is shown in FIG. 16. In this embodiment, the bottle 2 sits snugly within the insert 6, and there is no need for the neck and base holders 7,8.

It is to be understood that various alterations, additions and/or modifications may be made to the parts previously described without departing from the spirit and scope of the present invention, and that, in the light of the teachings of the present invention, the invention may be implemented in a variety of manners as would be understood by the skilled man.

In one variation, the hinge element 5 need not extend fully along the box 1, and a hinge element could for example be provided at each end of the box, Also, various of the parts, such as the tray insert 4, could be moulded from plastics, or could be fabricated from other materials, such as metal or wood, rather than being formed from a card blank.

What is claimed is:

1. A display box comprising:

a base tray having a rear wall, a lid having a rear wall, and a hinge element for connecting the lid with the base tray;

wherein the hinge element extends along and down from at least a part of an inner lower edge of the lid rear wall, and includes a flexible hinge portion that is attached to the lid and a rigid hinge portion that is mounted within the base tray and lies adjacent the rear wall of the base tray;

the arrangement of the base tray, lid and hinge element being such that when the lid is hinged open, the flexible hinge portion extends over and against an upper end of the base tray rear wall and is pulled taut between the rigid hinge portion and the lid under the influence of the weight of the open lid, the tension in the flexible hinge portion limiting the degree of opening of the lid and holding the lid in place, at an angle to the vertical.

2. The display box of claim 1, wherein the rigid hinge portion is mounted within the base tray such that it may move vertically parallel to the base tray's rear wall.

3. The display box of claim 1, wherein the box includes an insert for holding an item to be packaged.

4. The display box of claim 3, wherein the rigid hinge element is attached to the insert.

5. The display box of claim 3, wherein the insert is a tray insert.

6. The display box of claim 5, wherein the rigid hinge portion has a lower end along at least a portion of which is provided a tab portion, the tab portion being attached to the tray insert.

7. The display box of claim 6, wherein the tab portion is connected to a base portion of the tray insert.

8. The display box of claim 1, wherein when the box is closed, the base tray rear wall and lid rear wall are vertically offset from one another.

9. The display box of claim 1, wherein the base tray and lid are made from card blanks.

10. The display box of claim 1, wherein the flexible hinge portion is formed along its length, such that when the box is closed the lid is able to lie on the base tray with the rear walls of the lid and base tray lying flush with one another.

11. The display box of claim 1, wherein the lid and hinge element are formed integrally with one another.

12. A display box comprising:

a base tray having a rear wall, a lid having a rear wall, and a hinge element for connecting the lid with the base tray, wherein the hinge element extends along at least a part of an inner lower edge of the lid rear wall, and includes a flexible hinge portion that is attached to the lid and a rigid hinge portion that is mounted within the base tray and lies adjacent the rear wall of the base tray;

the arrangement of the base tray, lid and hinge element being such that when the lid is hinged open, the flexible hinge portion extends over an upper end of the base tray rear wall and is pulled taut between the rigid hinge portion and the lid under the influence of the weight of the open lid, the tension in the flexible hinge portion limiting the degree of opening of the lid and holding the lid in place, at an angle to the vertical;

wherein the lid and hinge element are formed integrally with one another from a blank, the rigid hinge portion being connected to the lid by a liner sheet, and the flexible hinge portion being formed from a portion of the liner sheet extending between the lid and the rigid hinge portion.

13. The display box of claim 12, wherein the lid and hinge element are covered with a wrap, the flexible hinge portion being formed from a portion of the liner sheet and a portion of the wrap.

14. A display box including a base tray, an insert within the base tray for holding an item for display, a lid, and a hinge element integrally formed with the lid for mounting the lid to the base tray, wherein:

the base tray includes a rear wall having an upper end;

the lid includes a rear wall having a lower inner edge from which the hinge element extends; and the hinge element includes a flexible hinge portion that extends from the lower inner edge of the lid rear wall to a rigid hinge portion lying within the base tray adjacent the base tray's rear wall, the rigid portion being attached to the insert;

the arrangement of the base tray, insert, lid and hinge element being such that when the lid is hinged open, the flexible hinge portion extends over and against the upper end of the base tray rear wall and is pulled taut against the insert via the rigid hinge portion under the influence of the weight of the lid, to limit the degree of opening of the lid and hold the lid in place, at an angle to the vertical.

15. A method of making a display box, the method comprising:

forming a base tray from a blank, the base tray having a rear wall;

forming a lid from a blank, the lid having a rear wall and a hinge element; and connecting the lid to the base tray through the hinge element;

wherein the hinge element includes a flexible hinge portion that extends from an inner lower edge of the lid rear wall, and a rigid hinge portion that is mounted within the base tray and lies adjacent the rear wall of the base tray;

the arrangement of the base tray, lid and hinge element being such that when the lid is hinged open, the flexible hinge portion extends over and against an upper end of the base tray rear wall and is pulled taut between the lid and the rigid hinge portion under the influence of the weight of the lid to limit the degree of opening of the lid and hold the lid in place, at an angle to the vertical.

16. A method of making a display box, the method comprising:

forming a base tray from a blank;

forming a lid and hinge element from a blank, including forming a slot in a blank sheet, providing a liner sheet at least across the slot on the side of the sheet that will be the inside of the box, and cutting a blank from the blank sheet such that the perimeter of the blank intersects the slot towards the ends of the slot so as to define a lid wall flap and a rigid hinge portion that are connected together by a flexible hinge portion formed from the liner sheet that extended across the slot;

and mounting the rigid hinge portion inside the base tray adjacent a rear wall of the base tray;

the arrangement of the base tray, lid and hinge element being such that when the lid is hinged open, the flexible hinge portion extends over an upper end of the base tray rear wall and is pulled taut between the rigid hinge portion and the lid under the influence of the weight of the lid to limit the degree of opening of the lid and hold the lid in place, at an angle to the vertical.

17. The method of claim 16, including the step of forming an insert for the base tray, and attaching the rigid hinge portion to the insert.

18. The method of claim 17, wherein a wrap is provided about the lid and hinge element, and wherein a portion of the wrap is formed to extend from an edge of the rigid hinge portion to form a tab portion, and wherein the tab portion is attached to the insert.

19. The method of claim 16, wherein the flexible hinge portion is formed along its length, such that when the lid is placed on the base tray, the lid and base tray rear walls lie flush with one another.

20. A display box comprising:

a base tray having a rear wall;

a lid including a rear wall; and a hinge element having a flexible hinge portion that extends from a lower inner edge of the lid rear wall to an inwardly facing surface of a rigid hinge portion, the rigid hinge portion lying within the base tray adjacent the base tray's rear wall and the flexible hinge portion being shaped along its length such that it forms a dog leg across its width, the arrangement of the base tray, lid and hinge element being such that when the display box is closed the lid and base tray lie flush with respect to one another, and such that when the lid is hinged open, the flexible hinge portion extends over and against an upper end of the base tray rear wall and is pulled taut between the rigid hinge portion and the lid under the influence of the weight of the lid to limit the degree of opening of the lid and hold the lid in place, at an angle to the vertical.

21. A method of making a display box, the method comprising:

forming a base tray from a blank, the base tray having a rear wall;

forming an integral lid and hinge element, the lid having a rear wall and the hinge element having a flexible portion that extends from an inner lower edge of the lid rear wall and a rigid portion that extends from the flexible portion;

shaping the flexible portion so as to take up a dog leg across its width; and connecting the lid to the base tray through the hinge element such that the rigid portion is mounted within the base tray and lies adjacent the rear wall of the base tray;

the arrangement of the base tray, lid and hinge element being such that when the display box is closed the lid and base tray lie flush with respect to one another, and such that when the lid is hinged open, the flexible hinge portion extends over and against an upper end of the base tray rear wall and is pulled taut between the rigid hinge portion and the lid under the influence of the weight of the lid to limit the degree of opening of the lid and hold the lid in place, at an angle to the vertical.

* * * * *